US005262263A

United States Patent [19]

Ohkawa et al.

[11] Patent Number: 5,262,263

[45] Date of Patent: Nov. 16, 1993

[54] LAYER ELECTROPHOTOGRAPHIC SENSITIVE MEMBER COMPRISING MORPHOUS SILICON

[75] Inventors: Kazumasa Ohkawa; Hisashi Higuchi; Hiroshi Hayashi; Shoji Mayama; Yoichiro Shimono, all of Yohkaichi, Japan

[73] Assignee: Kyocera Corporation, Kyoto, Japan

[21] Appl. No.: 732,749

[22] Filed: Jul. 18, 1991

Related U.S. Application Data

[63] Continuation of Ser. No. 418,550, Oct. 10, 1989, abandoned.

[30] Foreign Application Priority Data

Jan. 31, 1989 [JP] Japan ..... 1-22826

[51] Int. Cl.[5] ..... G03G 5/14

[52] U.S. Cl. ..... 430/66; 430/57; 430/83

[58] Field of Search ..... 430/66, 57, 83, 67

[56] References Cited

U.S. PATENT DOCUMENTS

| | | | |
|---|---|---|---|
| 4,656,110 | 4/1987 | Yanayaki | 430/57 |
| 4,738,913 | 4/1988 | Shirai et al. | 430/67 |
| 4,977,050 | 12/1990 | Kauamura et al. | 430/57 |

FOREIGN PATENT DOCUMENTS

| | | |
|---|---|---|
| 55-127083 | 10/1980 | Japan . |
| 57-11351 | 1/1982 | Japan . |
| 62-148966 | 7/1987 | Japan . |

*Primary Examiner*—Marion E. McCamish
*Assistant Examiner*—S. Rosasco
*Attorney, Agent, or Firm*—Spensley Horn Jubas & Lubitz

[57] ABSTRACT

The present invention relates to an improvement of an electrophotographic sensitive member comprising an amorphous silicon photoconductive layer and an amorphous silicon carbide surface layer formed on said amorphous silicon photoconductive layer.

An electrophotographic sensitive member with amorphous silicon as a photoconductive layer has been already practically used and a quantity thereof produced has been on the increase year by year. In this sensitive member, as a rule, in order to increase a surface hardness, a surface layer formed of amorphous silicon carbide has been formed.

An electrophotographic sensitive member with such two layers as the fundamental layer structure improved in charge acceptance, residual electric potential, photosensitivy and the like by forming a carrier blocking layer containing boron, oxygen, nitrogen and the like in a quantity within a desired range between a substrate for use in a sensitive member and the amorphous silicon photoconductive layer has been provided.

However, the above described sensitive member has shown problems in that a sufficiently high initial electric potential can not be obtained yet and an electric potential decayed until the development from the charging by a corona discharge to give the initial electric potential to the surface, that is a dark decay, is large, so that the sufficiently high surface electric potential can not be obtained in the development.

In view of the above described, it is an object of the present invention to provide an electrophotographic sensitive member which is improved in dark decay characteristics and capable of obtaining a high electric potential at a position where the development is conducted.

3 Claims, 6 Drawing Sheets

LAYER ELECTROPHOTOGRAPHIC SENSITIVE MEMBER COMPRISING MORPHOUS SILICON

This is a continuation of application Ser. No. 07/418,550 filed on Oct. 10, 1989, now abandoned.

BACKGROUND OF THE INVENTION

The present invention relates to an improvement of an electrophotographic sensitive member comprising an amorphous silicon photoconductive layer and an amorphous silicon carbide surface layer formed on said amorphous silicon photoconductive layer.

An electrophotographic sensitive member with amorphous silicon (hereinafter called a-Si for short) as a photoconductive layer has been already practically used and a quantity thereof produced has been on the increase year by year. In this sensitive member, as a rule, in order to increase a surface hardness, a surface layer formed of amorphous silicon carbide (hereinafter called a-SiC for short) has been formed.

An electrophotographic sensitive member with such two layers as the fundamental layer structure improved in charge acceptance, residual electric potential, photosensitivity and the like by forming a carrier blocking layer containing boron, oxygen nitrogen and the like in a quantity within a desired range between a substrate for use in a sensitive member and the a-Si photoconductive layer has been provided.

However, the above described sensitive member has shown problems in that a sufficiently high initial electric potential can not be obtained yet and an electric potential decayed until the development from the charging by a corona discharge to give the initial electric potential to the surface, that is a dark decay, is large, so that the sufficiently high surface electric potential can not be obtained in the development.

SUMMARY OF THE INVENTION

Thus, it is an object of the present invention to provide an electrophotographic sensitive member which is improved in dark decay characteristics and capable of obtaining a high electric potential at a position where the development is conducted.

That is to say, an electrophotographic sensitive member according to the present invention comprising an a-Si photoconductive layer and an a-SiC surface layer formed on a substrate in this order is characterized by that an intermediate layer of 10 to 2,000 Å thick, in which a carbon-content is gradually increased in the direction of layer-thickness, is formed between said both layers, a carbon-content, that is a value of x in $si_{l-x}C_x$ on a boundary surface of said intermediate layer and said photoconductive layer within a range $0<x \leqq 0.45$, and a carbon-content, that is a value of y in $Si_{l-y}C_y$ on a boundary surface of said intermediate layer and said surface layer being within a range $0.5 \leqq y \leqq 0.9$.

DETAILED DESCRIPTION OF THE INVENTION

The present invention will be below described in detail.

Figure 1:
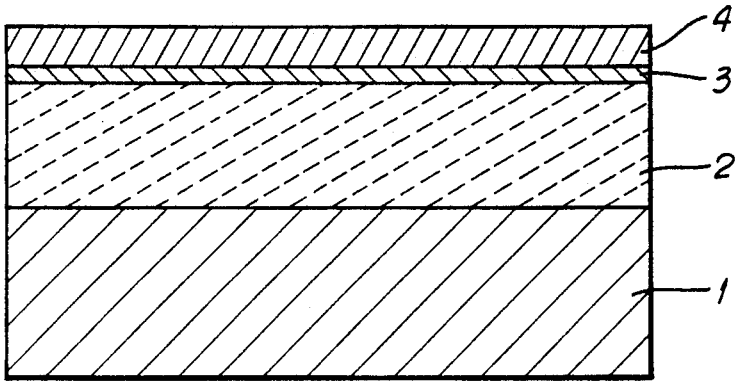
FIG. 1 is a sectional view showing a basic layer-structure of an electrophotographic sensitive member according to the present invention.
Figure 2:
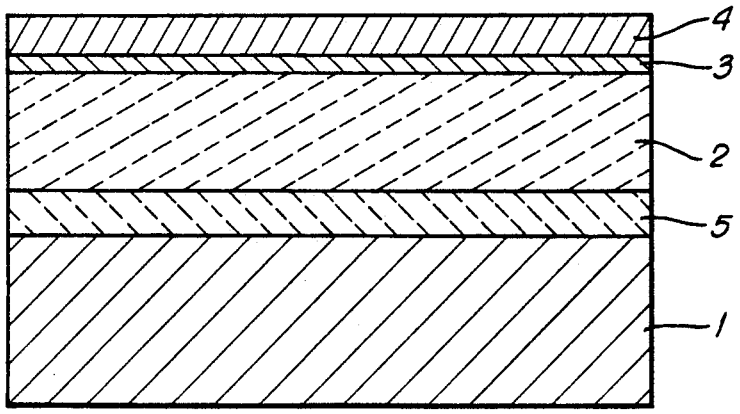
FIG. 2 is a sectional view showing a typical layer-structure of the electrophotographic sensitive member according to the present invention.
Figure 4:
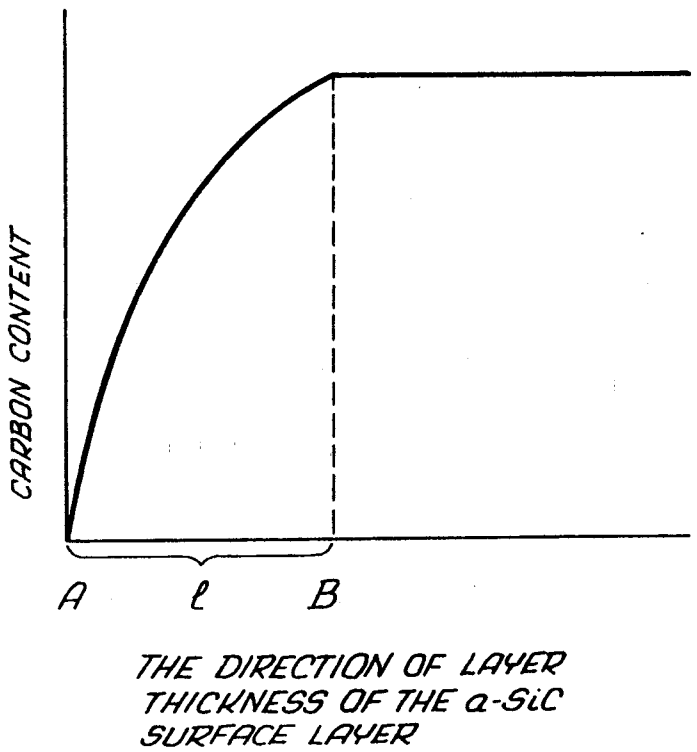
FIGS. 3 to 9 are graphs showing a carbon-content in the intermediate layer and the amorphous silicon carbide surface layer.

FIG. 1 shows a basic layer-structure of the electrophotographic sensitive member according to the present invention and FIG. 2 shows a typical layer-structure of the electrophotographic sensitive member according to the present invention.

Referring now to FIG. 1, an a-Si photoconductive layer 2, an intermediate layer 3 and an a-SiC surface layer 4 are formed on an electrically conductive substrate 1 formed of for example aluminum in this order by means of the glow discharge decomposition method and the like. Referring to FIG. 2, a carrier blocking layer 5 formed of a-Si and the like is additionally disposed between the substrate 1 and the a-Si photoconductive layer 2.

The present invention is characterized in that said intermediate layer 3 is formed between the known a-Si photoconductive layer 2 and a-SiC surface layer 4 to improve the dark decay characteristics and surface electric potential.

The carbon-content in this intermediate layer 3 is gradually increased between a point A, where the film-formation is started, and a point B, where the film-formation is finished, and the carbon-contents and film-thicknesses at the points A, B are set within the following ranges:

*A* - - - the value of $x$ in $Si_{1-x}C_x$ is set within a range $0 < x \leqq 0.45$, preferably $0 < x \leqq 0.3$.

*B* - - - the value of $y$ in $Si_{1-y}C_y$ is set within a range $0.5 \leqq y \leqq 0.9$, preferably $0.65 \leqq y \leqq 0.85$ Thickness $l$ - - - $10 \leqq l = 2.000$ Å, preferably $100 \leqq l \leqq 1,000$ Å

As to the carbon-content at the point A, if x exceeds 0.45, the blurring of image is occurred and the improvement in dark decay characteristics and surface electric potential can not be expected.

As to the carbon-content at the point B, if y is less than 0.5, a sufficient surface hardness can not be given to the surface layer 4 disposed on the point B while if y exceeds 0.9,the residual electric potential is increased.

As to the thickness l, if l is less than 10 Å, the improvement of the dark decay characteristics and surface electric potential can not be expected while if it exceeds 2,000 Å, the blurring of image is occurred.

As above described, the electrophotographic sensitive member according the present invention comprises the intermediate layer, of which carbon-content and thickness at the points A, B before and after the film-formation are set, but the carbon-content is changed in various kinds of manner in the direction of layer-thickness. They are shown in FIGS. 3 to 8.

Referring to these figures, an axis of abscissa shows the direction of layer-thickness of the intermediate layer 3 and the a-SiC surface layer 4 and an axis of ordinate shows the carbon-content (value of x).

Figure 9:
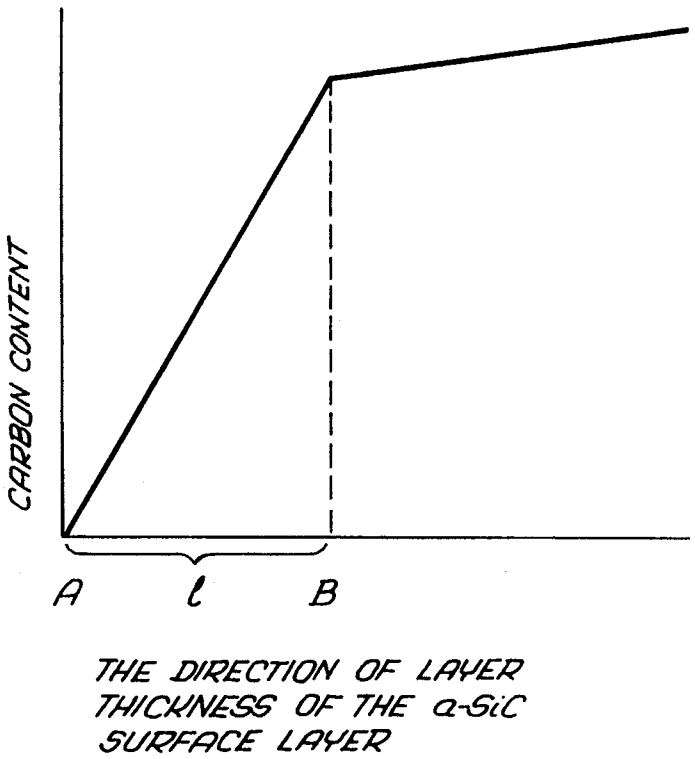

In addition, according to the present invention, the carbon-content in the a-SiC surface layer 4 may be increased towards the surface, as shown in FIG. 9, in addition to the case where it is substantially same as that at the point B, as shown in FIGS. 3 to 8.

Next, one example of the glow discharge decomposition apparatus used in preferred embodiments of the present invention will be below described with reference to FIG. 10.

Figure 10:
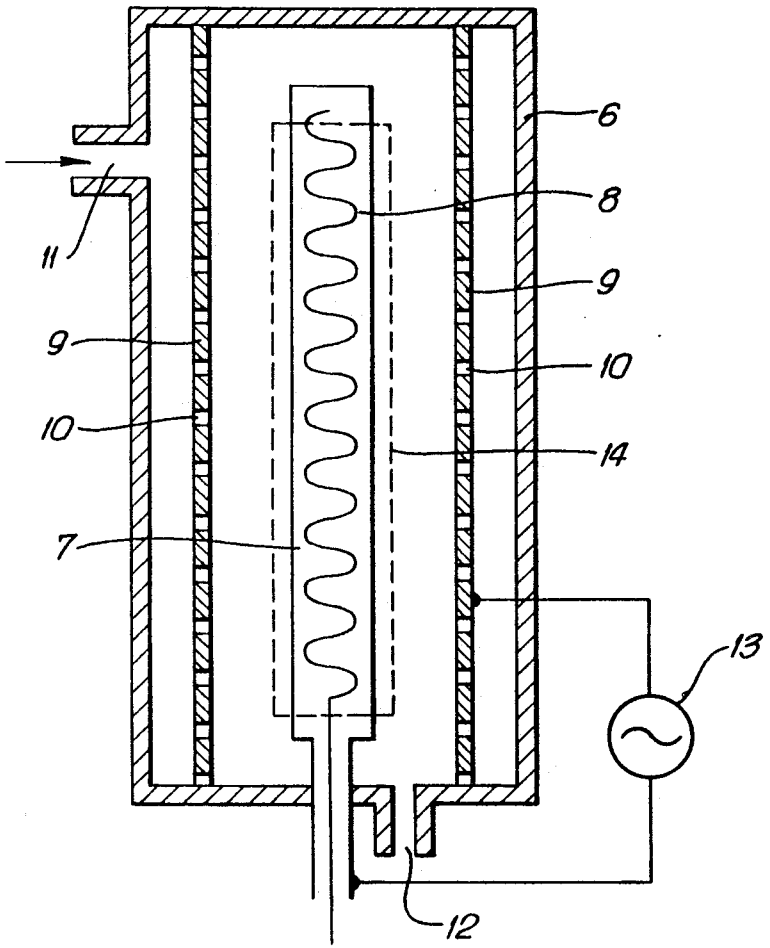
FIG. 10 is a schematic drawing showing a construction of a glow discharge decomposition apparatus used in preferred embodiments of the present invention.

Referring to FIG. 10, reference numeral 6 designates a cylindrical reaction chamber, reference numeral 7 designating a cylindrical electrically conductive substrate holder for use in a sensitive member drum device, reference numeral 8 designating a heater for heating the substrate, reference numeral 9 designating a cylindrical glow discharging electrode plate, said electrode plate 9 being provided with a gas-spouting port 10, reference numeral 11 designating a gas-inlet for introducing gases into an inside of said reaction chamber, reference numeral 12 designating an exhaust port for exhausting a residual gas which has been subjected to the glow discharge, and reference numeral 13 designating a high-frequency power source for generating the glow discharge between said substrate holder 7 and said glow discharging electrode plate 9.

In the case where an a-Si sensitive member is produced by the use of this glow discharge decomposition apparatus, a drum-like substrate 14 for forming an a-Si film thereon is mounted on the substrate holder 7, a thin-film forming gas being introduced into the inside of the reaction chamber, this gas being spouted onto the substrate surface through the gas-spouting port 10, a temperature of the substrate being set at a desired value by means of the heater 8, and the glow discharge being generated between the substrate holder 7 and the electrode plate 9 to form a thin film on a circumference of the substrate 14.

PREFERRED EMBODIMENTS

The present invention will be below described with reference to the preferred embodiments.

EXAMPLE 1

An electrophotographic sensitive member having a layer composition shown in Table 1 was produced by the use of the above described glow discharge decomposition apparatus shown in FIG. 10.

TABLE 1

Figure 3:
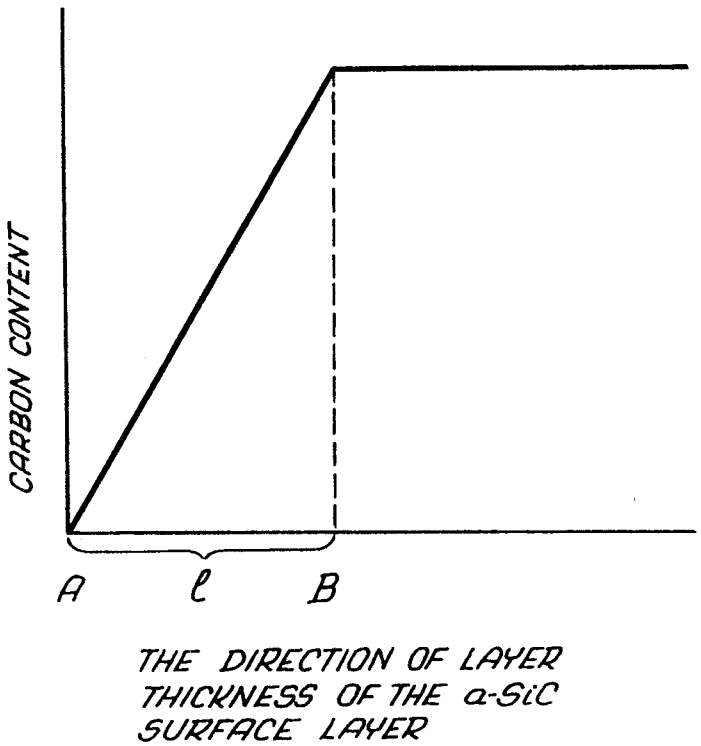
Figure 6:
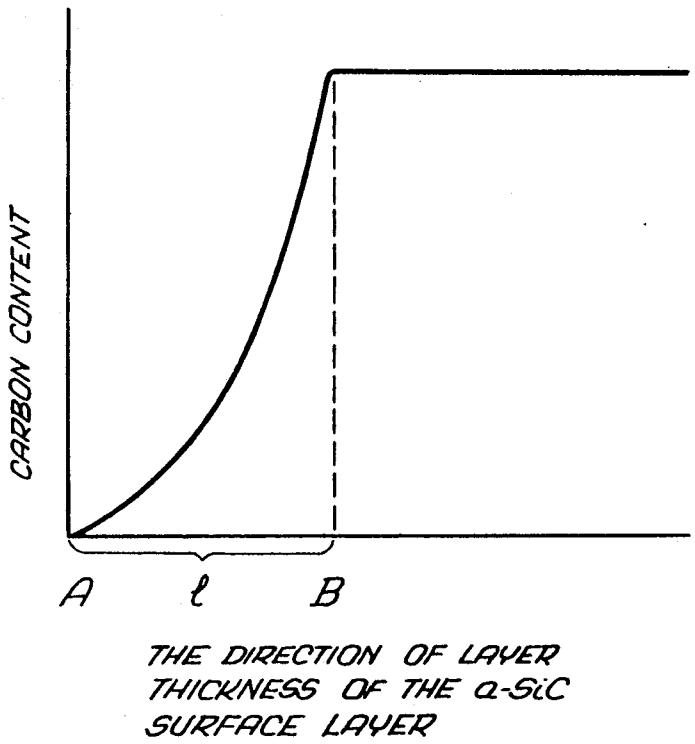
Figure 5:
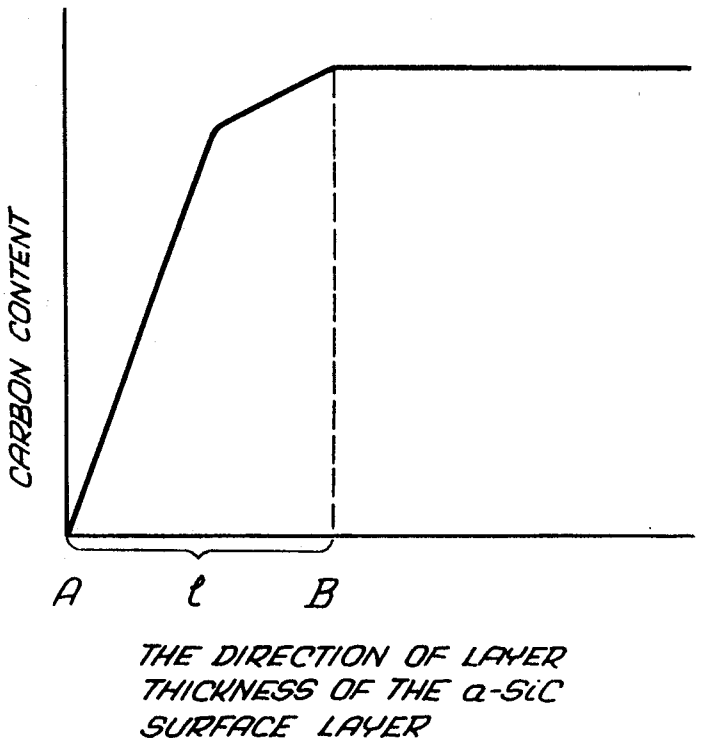
Figure 8:
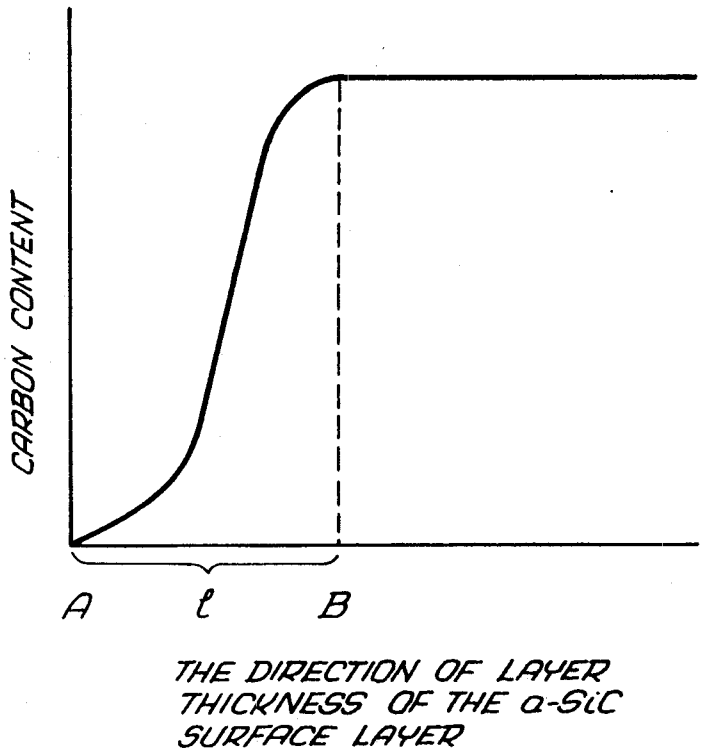
Figure 7:
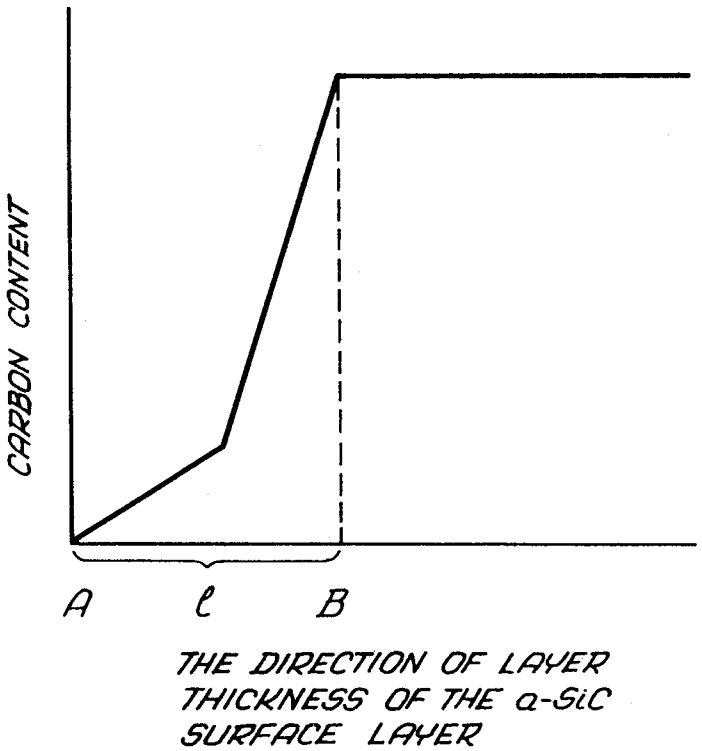

| Kind of layers | Ingredients and contents thereof | Thickness |
|---|---|---|
| Surface layer | a-Si(elemental ratio: $Si_{0.2}C_{0.8}$) | 5,000 Å |
| Intermediate layer | a-SiC; the carbon content is varied as shown in FIG. 3. | 400 Å |
| Photoconductive layer | a-Si, B . . . 0.5 ppm | 25 μm |
| Carrier-blocking layer | a-Si, B . . . 1,500 ppm: 0 . . . 1.0%; N . . . 0.7% | 2.5 μm |

Figure 11:
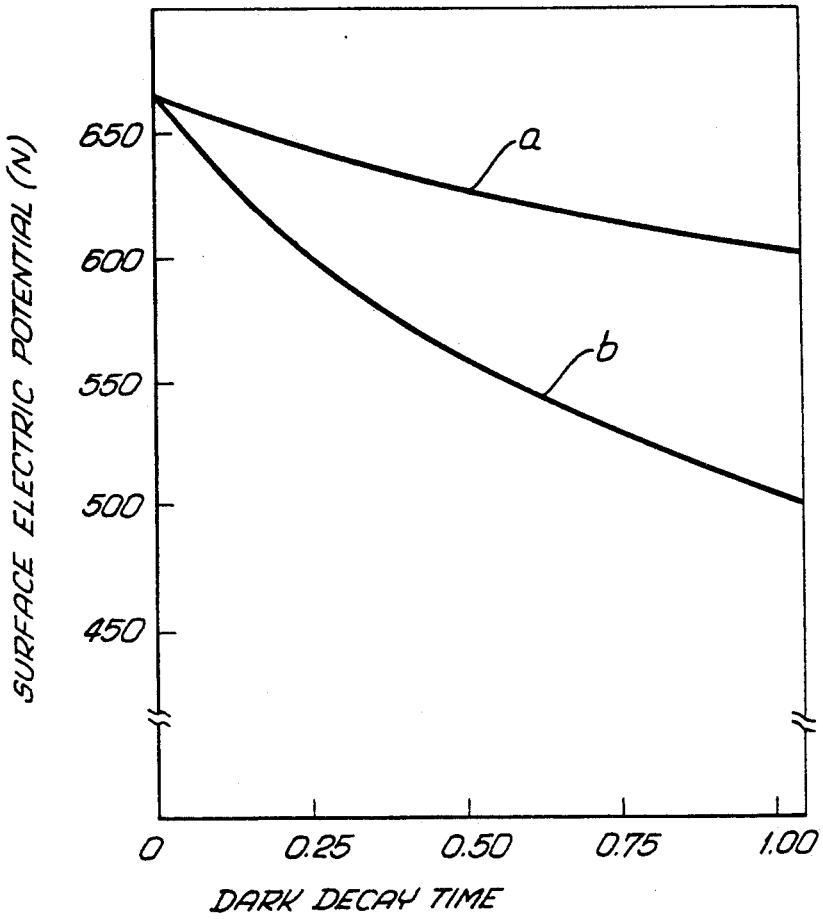
FIG. 11 is a graph showing a change of a surface electric potential resulting from the dark decay with a lapse of time.

The surface of the thus obtained electrophotographic sensitive member was charged at the corona electric current of 40 μA and the initial electric potential and the dark decay characteristics were measured with the results as shown in FIG. 11.

Referring to FIG. 11, an axis of abscissa designates a dark decay time (sec), an axis of ordinate designating a surface electric potential(V), and (a) designating the characteristic curve of the present EXAMPLE. In addition, the characteristic curve (b) in FIG. 11 is for an electrophotographic sensitive member as the COMPARATIVE EXAMPLE without comprising the intermediate layer but comprising other layers obtained in the same manner as in the present EXAMPLE.

As obvious from these results, the electrophotographic sensitive member was improved in dark decay characteristics and showed the enhanced surface electric potential.

EXAMPLE 2

In this EXAMPLE, the value of x in $Si_{l-x}C_x$ at A and the thickness of the intermediate layer were varied as shown in Table 2 and the value of x at B of the intermediate layer was set at 0.8 to produce various kinds of electrophotographic sensitive members.

In Table 2, a vertical column designates a value of x in $Si_{l-x}C_x$, a horizontal column designating a thickness l, and numerical values in the respective terms determined by both columns designating a surface electric potential (V) after 1 second from charging for the initial electric potential of 670 V.

TABLE 2

| | l (Å) | | | | | | | |
|---|---|---|---|---|---|---|---|---|
| Value of x | 0 | 50 | 200 | 400 | 950 | 1500 | 1900 | 2400 |
| 0 | — | — | — | 600 | — | — | — | 610 |
| 0.3 | — | 550 | 580 | 600 | 610 | — | 590 | 600 |
| 0.4 | — | — | — | 610 | — | 580 | — | — |
| 0.5 | — | — | — | 570 | — | — | — | — |
| 0.8 | 500 | — | — | — | — | — | — | — |

Figure 12:
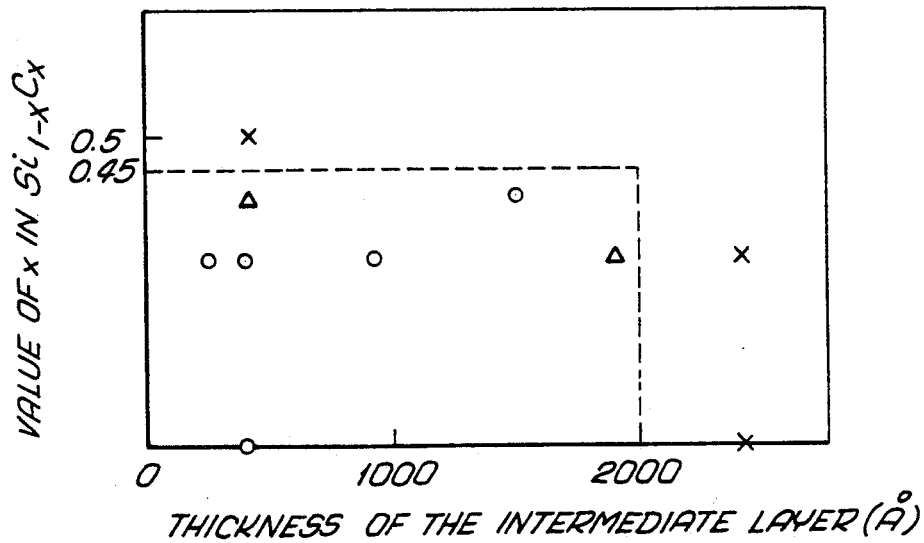
FIG. 12 is a plot diagram showing the results of the image evaluation for various kinds of sensitive member.

In addition, the blurring of image of the above described respective electrophotographic sensitive members was evaluated with the results as shown in FIG. 12.

Referring to FIG. 12, an axis of abscissa designates a thickness of the intermediate layer, an axis of ordinate designating the value of x in $Si_{l-x}C_x$ and the evaluation being classified into three kinds, that is o, Δ and x. Marks o show the cases where the clear image is obtained so that no blurring of image may be produced in the designated letter of the test chart even though the exposure is enhanced to twice the proper exposure for the sensitive member itself, marks Δ showing the cases where no blurring of image is produced in the designated letter at the proper exposure not to be hindered from practically using but the blurring of image is produced in the designated letter when the exposure is enhanced to twice the proper exposure, and marks x showing the cases where the blurring of image is produced at the proper exposure.

As obvious from Table 2, in the cases where $0<x\leqq 0.45$ and $10 \leqq l$ hold good, the surface electric potential of 550 V or more is obtained.

In addition, as obvious from FIG. 12, in the cases where $0<x\leqq 0.45$ and $10\leqq l\leqq 2{,}000$ Å hold good, the superior electrophotographic sensitive member having no problem in view of the blurring of image can be obtained.

EFFECTS OF THE INVENTION

As above described, according to the present invention, a highly effective electrophotographic sensitive member capable of obtaining a sufficiently enhanced initial electric potential and showing a reduced dark decay thereby obtaining a sufficiently enhanced surface electric potential in the development can be provided.

What is claimed is:

1. An electrophotographic sensitive member comprising an amorphous silicon photoconductive layer and an amorphous silicon carbide surface layer formed on a substrate in this order, characterized in that an intermediate layer, of which carbon-content is gradually increased in the direction of layer-thickness, is formed in a thickness of 10 to 2,000 Å between said both layers, a carbon-content, that is a value of x in $Si_{l-x}C_x$ on a boundary surface of said intermediate layer and said photoconductive layer being within a range of $0<x\leqq 0.45$, and a carbon-content, that is a value of y in $Si_{l-y}C_y$ on a boundary surface of said intermediate layer and said surface layer being within a range of $0.5\leqq y\leqq 0.9$.

2. An electrophotographic sensitive member as set forth in claim (1), in which the carbon-content of the amorphous silicon carbide surface layer is not substantially varied in the direction of layer-thickness.

3. An electrophotographic sensitive member as set forth in claim (1), in which the carbon-content of the amorphous silicon carbide surface layer is increased in the direction of layer-thickness towards the surface.

* * * * *